United States Patent [19]

Fenelon

[11] Patent Number: 4,956,821

[45] Date of Patent: Sep. 11, 1990

[54] SILO AND DELIVERY SYSTEM FOR PREMIXED DRY MORTAR BLENDS TO BATCH MIXERS

[76] Inventor: Terrance P. Fenelon, 173 Montrose Pl., St. Paul, Minn. 55104

[21] Appl. No.: 420,335

[22] Filed: Oct. 12, 1989

[51] Int. Cl.[5] ..... B28C 7/04

[52] U.S. Cl. ..... 366/8; 366/6; 366/9; 366/16; 366/21; 366/26; 366/41

[58] Field of Search ..... 366/2, 6, 8, 9, 16, 366/21, 26, 30, 41, 68, 182, 27, 606; 414/266–268

[56] References Cited

U.S. PATENT DOCUMENTS

| | | | |
|---|---|---|---|
| 894,749 | 7/1908 | Von Siller | 366/9 |
| 1,047,680 | 12/1912 | Mills et al. | 366/9 |
| 1,312,207 | 8/1919 | Randall | 366/6 |
| 2,073,652 | 3/1937 | Robb | 366/41 |
| 3,617,031 | 11/1971 | Paris | 366/41 |
| 3,917,236 | 11/1975 | Hanson | 366/9 |
| 4,075,711 | 2/1978 | Hall | 366/26 |
| 4,189,237 | 2/1980 | Bake | 366/8 |
| 4,358,205 | 11/1982 | Eakins | 414/268 |
| 4,384,787 | 5/1983 | Ito et al. | 366/40 |
| 4,798,475 | 1/1989 | Strandberg | 366/182 |

OTHER PUBLICATIONS

Brochure Cemen Tech, Inc. on Mobile Concrete Dispenser, models MCD6-100H and MDC6-150H, date unknown.

*Cemen-Tech.Gram* Publications No. 2, date 1981, entitled "Volumetric Proportioning and Continuous Mixing vs. Scales and Batch Mixing".

Advertisement Brochure Form No. 6F.1.5M of Cemen-Tech, Inc. entitled "Concrete Dispenser Model CMS-100", date unknown.

Photocopy of advertisement M-Tech Mortar Mixer, entitled "D-20 Mortar Mixer", date unknown.

Publication entitled *Southwest Builder,* Mar., 1987 edition, No. 8 "Innovation", section describing a Mege Mix Silo System.

Advertisement brochure by Standley Batch Systems, Inc. on various batch mixing apparatus, date unknown.

*Primary Examiner*—Timothy F. Simone

*Attorney, Agent, or Firm*—Merchant, Gould, Smith, Edell, Welter & Schmidt

[57] ABSTRACT

An improved silo and delivery system for efficiently handling dry mortar-blend compositions at construction sites is disclosed. Mortar-blend compositions are premixed to desired specifications and packaged at remote mixing stations into large bag containers that are transported to the construction site. A silo designed for uniquely servicing batch mixers is provided at the construction site for storing the premixed composition. The bag contents are emptied into the silo and are sealed therein against exposure to environmental elements. The silo contents are discharged by means of simple gravity flow on a batch-need basis into a batch mixer operatively underlying the silo.

17 Claims, 2 Drawing Sheets

SILO AND DELIVERY SYSTEM FOR PREMIXED DRY MORTAR BLENDS TO BATCH MIXERS

FIELD OF THE INVENTION

This invention relates generally to premixed dry mortar delivery systems and more particularly to an improved apparatus and method of delivering dry premixed mortar blend products on a demand basis to a batch mixing station at a construction site.

DESCRIPTION OF THE ART

A number of techniques and methods have been used over the years for delivering mortar products to a construction job site. The final application requires the totally mixed, ready-to-use mortar product to be delivered in a predetermined quantity or batch as dictated by the application in which the product will be used. The mortar products to which this invention apply can vary widely from, for example, conventional "concrete" mixes to bricklaying mortar mixes, to various types of grout mixes.

For larger applications, it has been customary to have the mortar product premixed with water or other liquid at a large batch mixing station remotely removed from the construction site, and by subsequently transporting the ready-to-use fully mixed product to the construction site by means of concrete moving trucks or the like where the concrete is poured directly from the trucks into forms or the like.

Other applications require or make it more feasible to mix the mortar-blend and water at the construction site itself. Such on-site mixing applications can be divided into: (1) those which use fixed quantity "batch" mixes such as might be produced by the well-known paddle wheel or rotary drum batch mixer which is capable of mixing several cubic feet of product at a time, and (2) those applications wherein a "continuous" mixing apparatus is used. The continuous mixing apparatus generally uses a rotatable screw or auger member which moves the mortar-blend/sand/water combination from an input port to a delivery or output port and simultaneously blends and mixes the combination as a result of the rotating motion of the screw or auger. Both the batch-type and the continuous screw/auger mixing apparatus require direct charging or loading of the mortar-blend product to be mixed with the water at the construction site. The continuous mixing apparatus generally requires a continuous charge of mortar-blend material to be introduced to its inlet port; whereas the batch-type mixer, such as the paddle wheel mixer, accepts a predetermined quantity of mortar-blend for each mixing cycle. While the present invention can be applied to continuous mixing applications, its most practical application is to batch mixing techniques.

The most rudimentary technique for providing a charge of dry mortar-blend to a batch mixer has been to hand-load the charge into the mixer at the beginning of a mixing cycle by hand-shoveling the proper proportions of sand and mortar components into the mixer. Since the mortar components are often packaged in 60 to 90-pound bags, it is commonplace for the operator to be required to open, lift and empty one or more such mortar containing bags into the mixing chamber and then add the desired amount of sand, aggregate or the like to the chamber, to complete the loading charge. Such techniques, besides being labor intensive, have often been found to be unacceptable for ensuring uniform mortar product mixes from batch-to-batch and have limited the number or types of mortar-blend mixes that can practically be produced at the job site. In addition, the dry mortar-blend product requires special handling and storage precautions to keep the mortar bags from being damaged and to keep the mortar dry prior to use. Further, smaller batches requiring the use of partial bags most often result in waste of the unused remaining contents of the bag due to the inability or lack of precaution in safely and dryly storing the unused contents until needed for a subsequent batch.

A number of different techniques have been tried in order to facilitate the handling and storage of dry mortar-blend products at the construction site. One technique has been to provide independent hoppers or silos at the construction site for bulk storing the various ingredients to be mixed such as the sand and the mortar-blend materials. Other mechanisms, particularly for continuous mixing systems, have been devised for proportionately metering and delivering the various components from the plurality of storage bins to the mixing apparatus. While such apparatus has been useful with "continuous" mixing apparatus, it has generally not proven to be particularly useful for batch-mixing applications. Further, such systems require relatively accurate metering apparatus which often proves to be unreliable and difficult to repair in the field. Such systems also require multiple product storage bins and multiple steps of independently loading each ingredient into its respective storage bin. In an effort to reduce the number of storage bins required at the construction site, larger and expensive multi-chambered bins or silos with relatively complicated discharge mechanisms have been devised.

Another problem associated with construction site logistics has been the handling, storing and transporting of bulk items such as dry concrete or other such bulk products. To simplify handling of such products, they have sometimes recently been packaged in reusable bags or container sacks. Such sacks are typically capable of holding up to 3,000 pounds or approximately 30 cubic feet of the bulk materials. Such bags are capable of being handled at the construction site by means of cranes or forklift tractors. Depending upon the contents of the bags, they can be emptied into holding containers until required for use. Such holding containers are typically in the nature of single compartment storage bins or hoppers. When the bags have been used to hold mortar products, the bins used to store such products have not been designed for direct cooperative use with the batch mixing apparatus at the construction site, requiring the mixer operator to physically shovel or otherwise load the premixed materials from the storage bin into the mixing apparatus.

While individual techniques have addressed one such problem at a time, no single mortar-blend delivery apparatus or method has been devised in the prior art which combines those most advantageous features which allow for simple, efficient and reliable delivery of premixed dry mortar-blend products to a batch mixing apparatus at the construction site, and which allows the mixing operator to reliably load any desired amount of the premixed material into the mixer, on demand. The present invention addresses and solves the above problems and shortcomings of the prior art.

SUMMARY OF THE INVENTION

This invention provides both apparatus and a method for delivering premixed dry mortar-blend materials to the construction site and for safely storing such materials in a manner such that they are immediately ready for use in a batch mixer apparatus. The invention further provides for reliably delivering, on demand, any desired amount of the stored mortar-blend materials directly into the mixing chamber of the mixer as simply directed by the mixer operator.

The invention provides for a unique system for delivering premixed dry mortar-blend compositions to a construction site and for subsequently handling the premixed compositions in a manner which protects the mix from segregation, in a manner which maintains the composition in a dry usable state, in a manner which minimizes handling of the composition at the job site and which enables gravity-flow loading of the composition into the batch mixer under accurate operator control. Integral to the inventive system is the construction of a portable silo for storing and delivering the dry mortar-blend composition material to the portable batch mixer. The silo has a chassis portion which defines an inner cavity for retainably storing a charge of premixed dry mortar-blend material composition and for maintaining such composition dry and protected from the external environment. According to a preferred embodiment of the invention, the inner cavity of the silo chassis is cooperatively defined by sidewalls, an upper wall and a lower wall. The upper wall has an inlet port to which is connected sealable inlet means through which the premixed mortar blend material can be introduced into the cavity. The lower portion of the chassis includes an outlet port with which discharge means are associated for releasing the mortar-blend composition material from the silo internal cavity. The silo includes leg means for elevating the silo chassis above a support surface at a height sufficient to cause the silo discharge means operatively overlie the inlet port of a portable batch mixer in a manner such that the discharge port does not interfere with the operation of the batch mixer therebelow. The discharge means is operable by an operator by means (in the preferred embodiment) of a simple lever mechanism which enables an operator to release or discharge only as much mortar-blend material from the site as is desired for any particular batch mixing operation. Material thus released from the internal cavity of the silo falls by gravity through the outlet port and discharge means of the silo into the underlying inlet port of the batch mixer. The silo may be optionally supplied with a sleeve-like member at its discharge end for further guiding the material being discharged from the silo, directly into the inlet port of the batch mixer so that the material does not refuse into the air as a result of wind gusts or the like.

The silo is preferably constructed for ease of construction at the job site and for ease of mobility to and from and around the site itself. To this end, the silo is preferably provided with means which enable ease of lifting and movement of the silo assembly either by a conventional forklift apparatus or by crane apparatus. The silo is also preferably constructed in a manner which enables the leg portions thereof to be separated from the silo body, thereby reducing the silo height for movement purposes. The silo construction is also configured in a manner such that the support legs thereof are sized and spaced so as to readily enable conventional batch mixers such as the well-known paddle wheel mixer to be operatively positioned between the silo legs without interfering with operation of the mixer.

An important aspect of the overall delivery system of the invention is the process of supplying the mortar-blend material held by the silo in completely premixed condition and packaged in relatively easy-to-use reusable carrying bags. The preferred carrying bag is of a size which permits ease of handling by a crane or forklift apparatus at the construction site, yet is sized large enough so as to minimize the number of repetitive steps required to charge or fully load a silo. Accordingly, the mortar-blend composition is preferably packaged in a relatively rugged flexible carrying bag which adequately supports the weight of its contents when lifted in overlying relationship to the silo and which can be readily opened to discharge its contents through the silo inlet port as it is held by the crane or forklift over the silo.

Accordingly, the invention provides a system for delivering premixed dry mortar-blend compositions to a batch mixer apparatus at a construction site, comprising the steps of: (a) providing a premixed dry mortar-blend composition packaged in a carrying bag of the type having means adequate to support lifting of the bag when filled and having discharge means for enabling discharge of the bag contents by gravity when in a lifted position; (b) providing a silo of the type having a sealable internal cavity suitable for retaining and storing a dry mortar-blend material, sealable upper inlet and lower discharge ports, and means for elevating the silo discharge ports sufficiently to overlie the inlet port of a batch mixer when operatively positioned below said discharge port; (c) elevating a bag of said premixed dry mortar-blend of step (a) in overlying relationship with said silo; (d) discharging the mortar-blend contents of said elevated bag into the internal cavity of said silo through said silo upper inlet port; (e) sealing the dry mortar-blend material within the silo internal cavity; (f) cooperatively positioning a batch mixer relative to said silo such that said silo discharge port operatively overlies the inlet port of said batch mixer; and (g) selectively discharging a portion of the silo contents by gravity through the silo discharge port, into the inlet port of the batch mixer.

While the invention will be described with respect to a particular preferred embodiment silo construction and shape, it should be noted that the invention is not limited by such silo shape as much as by the functional aspects thereof as they relate to their cooperation with a batch mixer at a construction site. Further, while the invention will be described with respect to a preferred type of paddle wheel batch mixer, it will be understood that the principles of this invention are not so limited but that they are to be broadly interpreted so as to cover other types of portable batch mixers typically used at construction sites. Similarly, while the invention will be described with respect to a particular construction of a mortar-blend carrying bag, other such containers may be used for transporting the premixed mortar-blend to the construction site and for loading the composition into the silo. Further, while the invention will be described with regard to several particular mortar-blend compositions, it will be understood that the basic principles of the invention apply to any type of mortar-blend compositions in general, where the critical requirement for such blends is that the composition remains dry in the silo and be subjected to a minimum of segregation of the constituent components thereof. These and other features of the invention will become obvious to those skilled in the art in view of a more detailed description thereof.

BRIEF DESCRIPTION OF THE DRAWING

Referring to the Drawing, wherein like numerals represent like parts throughout the several views.

DETAILED DESCRIPTION OF THE INVENTION

Figure 2:
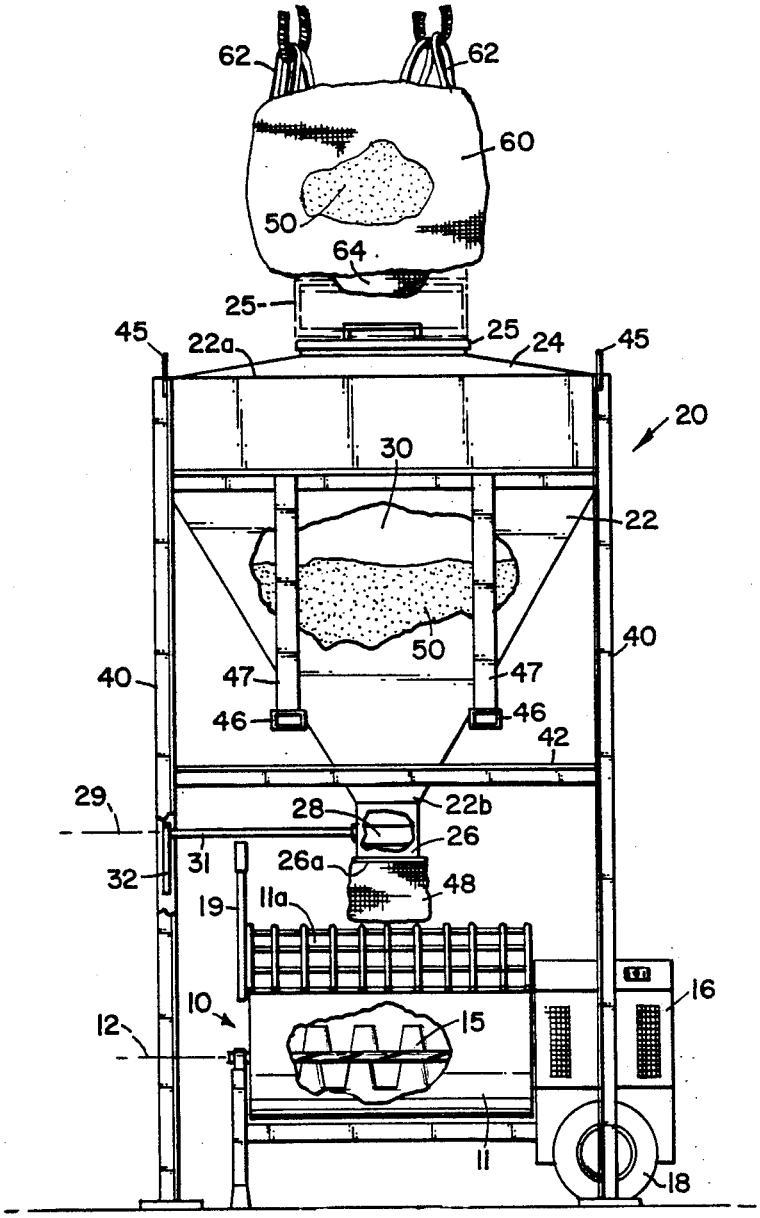
FIG. 2 is a view in front elevation of the silo and batch mixer combination of FIG. 1, with a carrying bag of premixed mortar-blend material illustrated in overlying relationship thereto, and with portions of the silo and batch mixer broken away.

As described above, the invention is particularly useful with batch mixing machines for mortar-blend compositions. The most typical and well-known of such batch mixer machines is that known as a paddle wheel machines such as illustrated at 10. Since such paddle wheel mixing machines are well-known in the art and in the construction industry, the details of the mixer 10 will not be belabored herein. In general, however, paddle wheel mixers have a mixing chamber 11 which is rotatable about a pivot axis 12. As illustrated in the Figures, the mixing chamber 11 defines an upwardly directed inlet port, generally designated at **11*a*, which is covered by a protective grid member 13. The grid member 13 can be rotatably moved relative to the mixing chamber to provide unobstructed access into the mixing chamber. A mixing paddle wheel assembly, generally illustrated at 15 in FIG. 2, is mounted for rotation about the axis 12 and is operatively connected (not illustrated) to an appropriate engine or motor, generally designated at 16 of the mixer. As the paddle wheel assembly 15 rotates about the axis 12, the contents within the mixing chamber 11 are mixed. As illustrated in the Figures, the mixer assembly 10 is generally mounted on a wheel and axle assembly, generally illustrated at 18 for ease of movement of the mixer in trailer-like fashion. The mixer also has a lever arm 19 used for rotating the entire mixing chamber 11 about the axis 12 between "mixing" (as illustrated in the Figures) and "discharging" positions. When rotated to a "discharge" position, the inlet port 11*a*** of the mixer is rotated toward the ground such that the contents of the mixer can be easily extracted therefrom. As stated above, those skilled in the art are well aware of the structure and nature of operation of such paddle wheel mixers, and further elaboration of such structures will not be belabored herein.

A preferred embodiment of a silo, generally illustrated at 20, is configured to overlie the batch mixer 10 and is sized and configured so as not to interfere with the mobility of the mixer into operative position below the silo or to interfere with the loading, mixing, unloading or cleaning operations normally associated with the mixer 10. Such construction will become more apparent upon a more detailed description of the silo. The silo 20 generally has a silo chassis defined by a plurality of sidewalls 22 generally extending between upper and lower ends **22*a* and 22*b* respectively and peripherally defining an internal or inner cavity 30. The silo chassis further has an upper wall member, generally designated at 24, which closes the upper portion of the internal cavity 30 and which also defines an inlet port 24*a* into the internal cavity. The inlet port 24*a* is closed by means of an inlet door 25 which is in the preferred embodiment pivotally mounted to the upper wall 24 and is movable between open and closed positions. When in a closed position, the door 25 effectively seals the inlet port 24*a*** from the external environment, thereby maintaining the contents of the inner cavity of the silo dry, or in their original condition.

Figure 1:
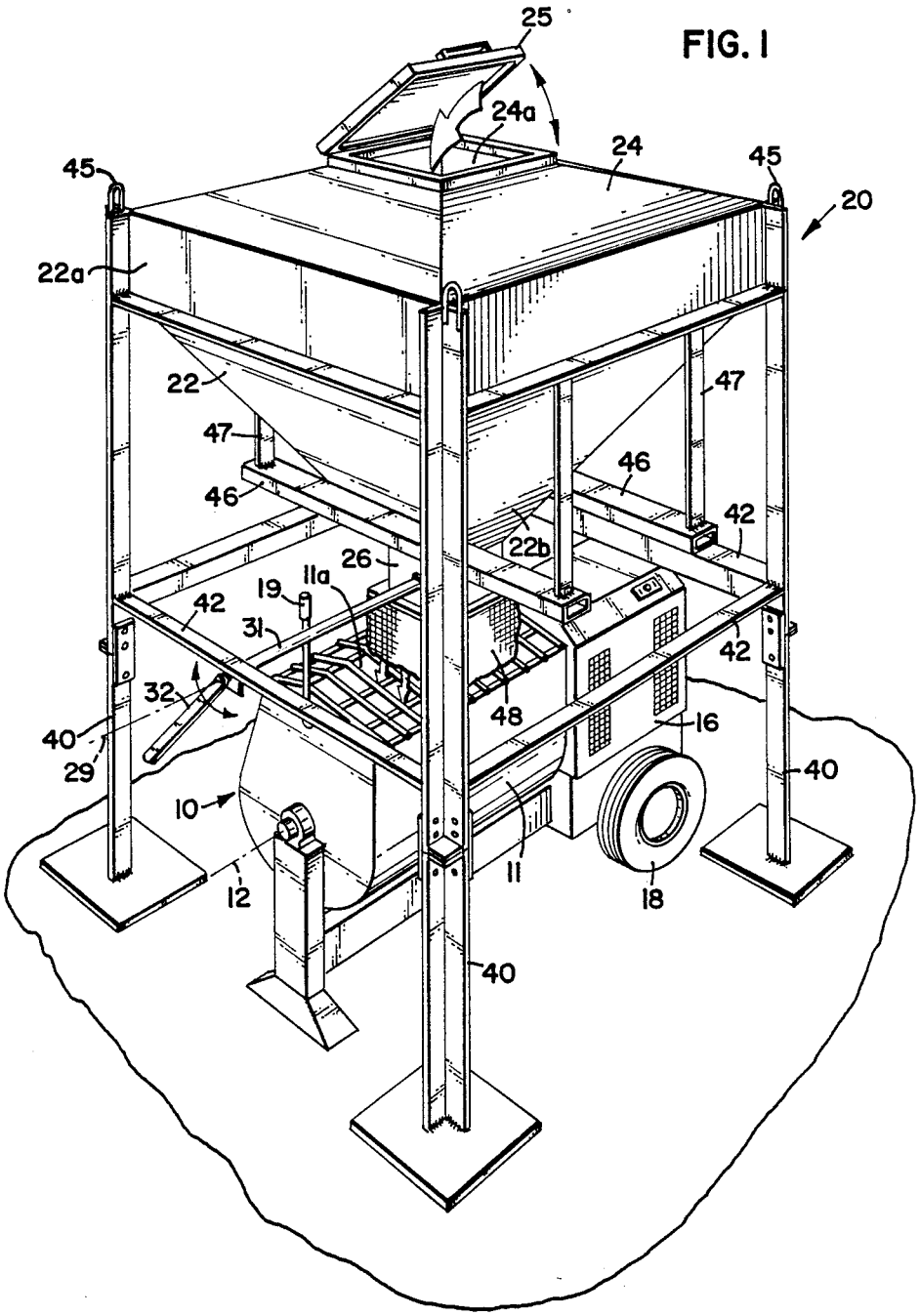
FIG. 1 is a perspective view of a silo constructed according to the principles of this invention and arranged in operative relationship to a portable batch mixer, as they might appear at a construction site.

A lower wall portion, generally designated at 26, cooperatively engages the sidewall members 22, and closes the lower portion of the internal cavity 30 of the silo. The lower wall 26 defines an outlet port **26*a* opening into the internal cavity and provides a discharge port or outlet for material to be discharged from the internal cavity 30. The outlet port is, in the preferred embodiment, selectively opened and closed by a clam gate member, generally illustrated at 28. The clam gate member 28 is of a type well-known in the art, pivotally mounted and operable about the pivot axis 29 to selectively and progressively open and close access through the outlet port 26*a* by means of its movable clam gate member. The movable clam gate member is operatively rotated by means of the shaft 31 the distal end of which is connected to an operator lever 32 as illustrated in FIG. 1**.

In the preferred embodiment, the upper silo chassis is supported by four vertical leg members 40 and associated cross-brace members 42, which support the silo chassis in elevated manner overlying the mixer 10. The support legs 40 are sized such that the lower extremity of the outlet port and lower wall 26 are raised from the ground a distance sufficient to enable the grid member 13 of the mixer and the mixing chamber 11 to be operatively moved without interference with the silo members. Similarly, the cross-brace members 42 are positioned at a height sufficient to enable freedom of operation and movement of the mixer 10 without being encumbered by the bracing or support structure. The operating shaft 31 of the clam gate member 28 is pivotally supported by one of the cross-brace members 42 as illustrated in FIG. 1. The leg members 40 are also preferably segmentable so that the entire silo structure can be readily disassembled for ease of movement and transport. The lower extremities of the support legs are affixed to support pads for supporting the weight of the silo and its contents.

The preferred embodiment of the silo structure includes a pair of support mechanisms for moving and supporting the silo during movement and assembly operations. A plurality of loop members, generally illustrated at 45, are welded or otherwise secured to the top portions of the legs 40 and are of sufficient strength to enable a crane to lift the entire silo assembly thereby. A second support assembly, illustrated by the spaced channel members 46 and their associated support posts 47 are provided for enabling ease of movement of the silo structure by a conventional forklift apparatus. The channel members 46 are appropriately spaced so as to identically align with the spacing of the forklift arms of a conventional forklift tractor.

As illustrated in the figures, the outlet or discharge port **26*a* of the silo is sized so as to discharge material from the internal cavity 30 of the silo directly into the underlying inlet port of the batch mixer 10, without causing undue scatter or spillage of the material. However, in order to further ensure that material discharged from the internal cavity 30 will proceed directly into the inlet port of the batch mixer 10 in the event that the assembly is operated in areas of severe wind or other adverse environmental conditions, a flexible sleeve member 48 is provided to further direct the discharged silo contents into the batch mixer. In the preferred embodiment, the sleeve member 48 is constructed of pliable material such as canvas or woven polypropylene which does not interfere with the operations of the batch mixer 10**.

The upper wall 24 is illustrated in the preferred embodiment as being angled so as to repel water. Also, the sidewall construction of the silo illustrated in the preferred embodiment has upper extended portions which provide increased capacity to the internal cavity. It will readily be understood by those skilled in the art that the particular silo configuration illustrated is not required by the invention, but that many alternative configurations and variations thereof can be envisioned by those skilled in the art.

An operator opens and closes the clam gate member 28 by moving the operator lever 32 between first and second positions. Referring to FIG. 1, the operator lever 32 is in a first position when it is horizontal, which results in the clam gate member being rotated to a closed position, preventing discharge from the outlet port 26*a*, and is positionable in a second (vertical) position which enables full opening of the clam gate member 28, enabling full discharge of material through the outlet port 26*a*. An operator can progressively move the operator lever to any position between the above-described first and second positions, so as to control the amount and rate of discharge flow from the internal cavity through the discharge outlet port. The well-known clam gate mechanism further provides high reliability and ease of operation of the discharge process from the silo in a manner which is relatively insusceptible to wear or damage by the contents being discharged from the silo.

While the mortar-blend composition materials can be handled and loaded into the internal cavity of the silo by a number of different methods, a preferable method is to transport premixed mortar-blend compositions to the construction site in prepackaged bags and to directly empty the bags into the silo. It has been found that the most convenient packaging means are large flexible bags constructed of woven polypropylene ultraviolet treated coated fabric of the type, for example, manufactured by Bulk Lift International Incorporated. A diagrammatic illustration of such a bag is depicted in FIG. 2. While such bags could be of any size, the preferable configuration is one that holds approximately 30 cubic feet or 3,000 pounds of mortar-blend material. Bags of such size are capable of being readily handled by either a crane or forklift at the job site, and also hold adequate quantities of material so as to require fewer loading processes to be performed in order to fill the silo to its desired capacity. The mortar-blend containing bag preferably has four top-mounted double-lifting loops 62 that can be engaged by either a crane or forklift. The bags 60 also preferably have a duffle-top configuration through which the bag is loaded at a remote mixing plant and a lower outlet spout, generally designated at 64, that is held closed by a safety rope member (not illustrated). The premixed mortar-blend composition placed in the bags may be of any blend percentage required by the application with which the delivery system is used. Generally, the mix specifications are set forth in a specification standard such as, for example, ASTM:C270 or the like. The advantage of premixing and prepackaging the mortar-blend at a large blending facility, as described above, rather than at the construction site is that more accurate and consistent mixes can be achieved with significantly less waste and labor.

When emptying the contents of a bag 60 into the silo, the bag 60 is lifted by means of its lifting loops 62 in overlying relationship with the upper inlet port 23*a* of the silo and the inlet door 25 is rotated to an open position. The lower outlet spout 64 of the bag 60 is centered over the inlet port and the locking rope holding the outlet spout 64 closed is released so as to open the outlet spout and release the contents of the bag directly into the inlet port of the silo. The inlet door 25 is then closed to seal the internal cavity 30 from the external environment.

When it is desired to load a "batch" of the premixed dry mortar-blend material contained by the silo into the batch mixer, an operator simply rotates the operator lever 32 and simultaneously watches the premixed material empty through the silo discharge port into the batch mixer, until the desired batch amount is loaded into the mixer. The operator then simply returns the operator lever 32 to its first position to close the clam gate member and proceeds with adding water to the batch mixer and operation of the batch mixer as he normally would. In this manner, the operator can prepare only that amount of batch material that he desires at any one time, and is assured of the proper mortar-blend proportions for the particular application, for every batch he mixes.

While the present invention has been described with respect to its application as illustrated in the preferred embodiment, it will be understood that a number of variations of the embodiment and its applications for use with other batch mixers and for mortar-blend compositions other than those disclosed, are possible. Such modifications of the invention will become apparent to those skilled in the art, in light of the foregoing description. This description is intended to provide a specific example of an embodiment which clearly distinguishes and discloses the present invention. Accordingly, the invention is not limited to the described embodiment or to the use of specific components, mortar-blend compositions or any particular batch mixer described herein. All alternative modifications and variations of the present invention which fall within the broad scope of the appended claims are covered.

What is claimed is:

1. A portable silo for storing and delivering premixed dry mortar-blend materials to an inlet port of a portable batch mixer apparatus of the type used at a construction site, comprising:

(a) a silo chassis defining an inner cavity for retainably storing a charge of premixed dry mortar-blend material, comprising:

(i) a sidewall portion extending between upper and lower ends and peripherally defining said inner cavity;

(ii) upper wall means cooperatively engaging said sidewall portion upper end for closing the inner cavity at its upper end, said upper wall means defining an inlet port opening into said inner cavity; and (iii) lower wall means for closing the inner cavity at its lower end, said lower wall means defining an outlet port opening into said inner cavity;

(b) inlet means cooperatively connected with said upper wall means for selectively providing sealed closure and open access to said inner cavity through said inlet port;

(c) discharge means cooperatively connected with said lower wall means for selectively providing sealed closure and open access to said inner cavity through said outlet port; said discharge means being operable between closed and open positions; said discharge means when in said closed position being operable to sealingly close said outlet port of the inner cavity to prevent mortar-blend material within said inner cavity from passing through said outlet port and being operable between said closed and said open positions to enable measured amounts of mortar-blend material within said inner cavity to pass by gravity through said outlet port; and (d) leg means operatively connected with said chassis for elevating said chassis above a support surface such that said discharge means operatively overlies an inlet port of a portable batch mixer supported by said support surface, said leg means being arranged and configured to allow the portable batch mixer to operatively stand therebetween; whereby material leaving said inner cavity through said discharge means falls by gravity into the inlet port of the batch mixer.

2. The portable silo as recited in claim 1, wherein said inlet means comprises a door member mounted to said upper wall for pivotally rotating between a closed position in sealing engagement with said upper wall to close said inlet port, and an open position to allow mortar-blend material to be introduced to said inner cavity through said inlet port.

3. The portable silo as recited in claim 1, wherein said discharge means includes an operator lever disposed adjacent said outlet port, said operator lever being movable between first and second positions and being operatively connected so as to cause said discharge means to move between said closed and said open positions as said lever moves between said first and said second positions.

4. The portable silo as recited in claim 3, wherein said operator lever is arranged and configured relative to said discharge means such that an operator can move said lever between said first and said second positions while directly observing the material flowing through said discharge means into the inlet port of the batch mixer.

5. The portable silo as recited in claim 1, wherein said discharge means includes a clam gate apparatus operatively connected to selectively open and close access through said outlet port into said inner cavity.

6. The portable silo as recited in claim 1, wherein said discharge means includes a flexible sleeve means operatively connected to direct material flowing by gravity through said outlet port to the inlet port of the batch mixer, for reducing scatter of the material during passage thereof between the chassis outlet port and the batch mixer inlet port.

7. The portable silo as recited in claim 1, further including lifting means for enabling said silo chassis to be portably lifted and moved.

8. The portable silo as recited in claim 7, wherein said lifting means includes spaced support members operatively connected to said silo chassis, said support members being spaced to cooperatively align with the lifting fork arms of standard forklift moving equipment.

9. The portable silo as recited in claim 7, wherein said lifting means includes hook members mounted to said silo chassis for enabling lifting of said chassis by a crane apparatus.

10. The portable silo as recited in claim 1, wherein at least a portion of said leg means is detachable from said silo chassis for enabling separate movement of said leg means and said silo chassis.

11. A system for delivering premixed dry mortar-blend compositions to a batch mixer apparatus at a construction site, comprising the steps of:

(a) providing a premixed dry mortar-blend composition packaged in a carrying bag of the type having means adequate to support lifting of the bag when filled and having discharge means for enabling discharge of the bag contents by gravity when in a lifted position;

(b) providing a silo of the type having a sealable internal cavity suitable for retaining and storing a dry mortar-blend material, sealable upper inlet and lower discharge ports, and means for elevating the silo discharge port sufficiently to overlie the inlet port of a batch mixer when operatively positioned below said discharge port;

(c) elevating a bag of said premixed dry mortar-blend of step (a) in overlying relationship with said silo;

(d) discharging the mortar-blend contents of said elevated bag into the internal cavity of said silo through said silo upper inlet port;

(e) sealing the dry mortar-blend material within the silo internal cavity;

(f) cooperatively positioning a batch mixer relative to said silo such that said silo discharge port operatively overlies the inlet port of said batch mixer; and (g) selectively discharging a portion of the silo contents by gravity through the silo discharge port, into the inlet port of the batch mixer.

12. The delivery system as recited in claim 11, wherein the step of selectively discharging the silo contents includes the step of discharging only so much of the mortar-blend material through said discharge port as is desired for any one mixing operation of the batch mixer.

13. The delivery system as recited in claim 11, further including the step of guidably directing the gravity flow of material from the silo discharge port to the inlet port of the batch mixer.

14. The delivery system as recited in claim 11, further including the step of guidably directing the gravity flow of material from the silo discharge port to the inlet port of the batch mixer by means of a flexible sleeve member through which said material flows.

15. The delivery system as recited in claim 11, wherein the step of selectively discharging the silo contents includes the steps of controlling the rate of opening and the degree and time for which said discharge port to said internal cavity is opened.

16. The delivery system as recited in claim 11, wherein the step of positioning a batch mixer relative to said silo comprises cooperatively positioning a batch mixer of the paddle wheel type relative to said silo.

17. The delivery system as recited in claim 11, wherein the step of selectively discharging said silo contents through said discharge port comprises the step of controllably moving the jaws of a clam gate member operatively disposed across said discharge port.

* * * * *